US007441407B2

(12) United States Patent
Sawada

(10) Patent No.: US 7,441,407 B2
(45) Date of Patent: Oct. 28, 2008

(54) HYDRAULIC DRIVE CONTROL DEVICE

(75) Inventor: Hiroshi Sawada, Neyagawa (JP)

(73) Assignee: Komatsu Ltd., Tokyo (JP)

( * ) Notice: Subject to any disclaimer, the term of this patent is extended or adjusted under 35 U.S.C. 154(b) by 371 days.

(21) Appl. No.: 10/567,674

(22) PCT Filed: Aug. 9, 2004

(86) PCT No.: PCT/JP2004/011438

§ 371 (c)(1),
(2), (4) Date: Feb. 9, 2006

(87) PCT Pub. No.: WO2005/019656

PCT Pub. Date: Mar. 3, 2005

(65) Prior Publication Data

US 2006/0230752 A1 Oct. 19, 2006

(30) Foreign Application Priority Data

Aug. 20, 2003 (JP) ..... 2003-296557

(51) Int. Cl.
*F16D 31/02* (2006.01)
*F15B 11/08* (2006.01)

(52) U.S. Cl. ..... 60/431; 60/433; 91/450

(58) Field of Classification Search ..... 60/431, 60/433, 434; 91/449, 450, 451
See application file for complete search history.

(56) References Cited

U.S. PATENT DOCUMENTS 3,960,059 A * 6/1976 Schexnayder ..... 91/450
4,425,759 A 1/1984 Krusche
5,950,519 A * 9/1999 Anatoli ..... 91/450
6,026,730 A 2/2000 Yoshida et al.

FOREIGN PATENT DOCUMENTS

| | | | |
|---|---|---|---|
| JP | 57-116965 | A | 7/1982 |
| JP | 58-135341 | A | 8/1983 |
| JP | 03-129108 | A | 6/1991 |
| JP | 07-054805 | A | 2/1995 |
| JP | 2002-266379 | A | 9/2002 |
| JP | 2002-339904 | A | 11/2002 |
| JP | 2004-036681 | A | 2/2004 |

* cited by examiner

*Primary Examiner*—Michael Leslie
(74) *Attorney, Agent, or Firm*—Frishauf, Holtz, Goodman & Chick, P.C.

(57) ABSTRACT

A hydraulic drive control device which is capable of translating the effect of oil pressure loss reduction into the effect of fuel consumption reduction that is very real to the user. The hydraulic drive control device has (i) a driving hydraulic circuit for driving a hydraulic actuator by supplying pressure oil to or draining it from the hydraulic actuator through control valves, the pressure oil being discharged from a hydraulic pump driven by an engine and (ii) a quick return circuit for directly flowing part of hydraulic oil discharged from the hydraulic actuator back to a tank, while the hydraulic actuator being driven. The hydraulic drive control device also includes an engine controller for controlling the output of the engine such that the output of the engine is restricted when the quick return circuit is opened.

4 Claims, 6 Drawing Sheets

HYDRAULIC DRIVE CONTROL DEVICE

This application is a U.S. National Phase Application under 35 USC 371 of International Application PCT/JP2004/011438 filed Aug. 9, 2004.

TECHNICAL FIELD

The present invention relates to a hydraulic drive control device for controlling, for example, the hydraulic drive system of a hydraulic excavator.

BACKGROUND ART

Ordinary hydraulic excavators are equipped with a variable displacement hydraulic pump driven by an engine and are formed such that pressure oil discharged from this hydraulic pump is supplied to and drained from various hydraulic actuators through control valves, thereby respectively controlling driving of a work implement, a swivel and a travel gear unit. In such hydraulic excavators, iso-horsepower control for constantly controlling the absorption horsepower [=P (discharge pressure)×Q (discharge flow rate)] of the hydraulic pump is performed in order to match the output torque characteristic of the engine with the absorption torque characteristic of the hydraulic pump in the high fuel efficiency region of the engine.

There is a known technique (e.g., Patent Document 1) according to which a hydraulic excavator of the above type is provided with (i) a main reflux flow path for flowing hydraulic oil back to a tank through a control valve, the hydraulic oil being pushed out from an arm cylinder during arm dumping operation in which the arm is operated to turn in a forward direction and (ii) a sub reflux flow path for directly flowing part of the hydraulic oil back to the tank. With this arrangement, pressure loses in the return circuit during the arm dumping operation can be restricted thereby lowering working pressure to reduce the loss of oil pressure.

Patent Document 1: Japanese Unexamined Published Patent Application No. 2002-339904

There is another known technique according to which two hydraulic pumps of the above type are serially disposed and switching between a split-flow condition and an interflow condition is enabled. In the split-flow condition, the discharge oil of one of the hydraulic pumps is supplied to the arm cylinder whereas the discharge oil of the other is supplied to the bucket cylinder. In the interflow condition, the discharge oils of the hydraulic pumps are joined together and supplied to either one of the arm cylinder and the bucket cylinder in preference to the other. In the split-flow condition, the loss of oil pressure can be reduced. In the interflow condition, the excavating operation of either the arm or bucket can be speeded up.

DISCLOSURE OF THE INVENTION

Problems that the Invention is to Solve

In each of the above prior art techniques, since the output of the hydraulic pump(s) is controlled to have a certain value, a reduction in the loss of oil pressure leads to an increase in the amount of discharge oil of the hydraulic pump so that an increased work rate can be achieved. In spite of such a desirable effect, that is, a reduction in fuel consumption per work unit resulting from an increase in work rate, the user hardly feels the benefit of this effect.

The invention is directed to overcoming the foregoing problem and a primary object of the invention is therefore to provide a hydraulic drive control device capable of translating an oil pressure reducing effect into a fuel consumption reducing effect that is very real to the user.

Means of Solving the Problems

In accomplishing the above object, there has been provided, in accordance with a first invention, a hydraulic drive control device comprising (i) a driving hydraulic circuit for driving a hydraulic actuator by supplying pressure oil to or draining it from the hydraulic actuator through a control valve, the pressure oil being discharged from a hydraulic pump driven by an engine and (ii) a quick return circuit for directly flowing a part of hydraulic oil discharged from the hydraulic actuator back to a tank, while the hydraulic actuator being driven, the hydraulic drive control device further comprising:

engine controlling means for controlling an output of the engine such that the output of the engine is restricted when the quick return circuit is opened.

In the first invention, it is preferable that back pressure detecting means for detecting a back pressure of the quick return circuit be provided and that the engine controlling means adjust an amount of restricting the output of the engine based on a value of the back pressure detected by the back pressure detecting means (second invention).

In the first or second invention, it is preferable that the hydraulic actuator be an arm cylinder for a hydraulic excavator and that the quick return circuit be operated during dumping operation of an arm (third invention).

There is provided, according to a fourth invention, a hydraulic drive control device comprising a plurality of hydraulic circuit sections for driving their associated hydraulic actuators by pressure oil discharged from their associated hydraulic pumps that use an engine as a driving source, the hydraulic drive control device being switchable between an interflow condition and a split-flow condition, the interflow condition being such that the hydraulic drive control device is driven with one of the plurality of hydraulic circuit sections being connected to another of the hydraulic circuit sections, the split-flow condition being such that the hydraulic drive control device is driven with the one of the plurality of the hydraulic circuit sections being separated from the another of the hydraulic circuit sections, the hydraulic drive control device further comprising:

engine controlling means for controlling an output of the engine such that the output of the engine is restricted while the hydraulic drive control device being switched from the interflow condition to the split-flow condition.

In the fourth invention, the switching between the interflow condition and the split-flow condition is preferably done based on discharge pressures of the hydraulic pumps (fifth invention).

In the fourth or fifth invention, it is preferable that the hydraulic actuator corresponding to the one of the plurality of the hydraulic circuit sections be an arm cylinder for a hydraulic excavator and the hydraulic actuator corresponding to the another of the hydraulic circuit sections be a bucket cylinder for the hydraulic excavator and that the hydraulic drive control device is switched from the interflow condition to the split-flow condition when a discharge pressure of the hydraulic pump of the one of the plurality of the hydraulic circuit sections or the discharge pressure of the hydraulic pump of the another of the hydraulic circuit sections reaches a specified value during excavation performed by simultaneous operations of the arm cylinder and the bucket cylinder (sixth invention).

Effects of the Invention

According to the first invention, the loss of oil pressure is reduced by opening of the quick return circuit, whereby the working pressure necessary for driving the hydraulic actuators is reduced and therefore the work load of the engine is reduced. In addition, when the quick return circuit is opened, the engine controlling means restricts the output of the engine. In this invention, since engine load is lessened by opening the quick return circuit and the output of the engine is controlled according to this, fuel consumption can be reduced without giving a feeling of operational disorder to the operator even when the output of the engine drops. In this way, the oil pressure loss reducing effect can be translated into the fuel consumption reducing effect that is very real to the user.

By use of the arrangement of the second invention, the fuel consumption reducing effect corresponding to the oil pressure loss reducing effect can be achieved without fail.

Use of the arrangement of the third invention makes it possible to reduce the loss of oil pressure during arm dumping operation that accounts for a relatively large part of the operation done by the hydraulic excavator and to translate such an oil pressure loss reducing effect into the fuel consumption reducing effect. Therefore, the third invention can provide a hydraulic excavator which achieves the fuel consumption reducing effect that is more realistic to the user.

According to the fourth invention, the output of the engine is restricted as the load on the engine is lessened by a reduction in the loss of oil pressure when the interflow condition in which driving is performed with the first and second hydraulic circuit sections being connected to each other is switched to the split-flow condition in which driving is performed with the first and second hydraulic circuit sections being separated from each other. Therefore, the oil pressure loss reducing effect can be translated, similarly to the first invention, into the fuel consumption reducing effect that is very real to the user.

Use of the arrangement of the fifth embodiment allows the switching from the interflow condition to the split-flow condition to be more properly performed, so that the fuel consumption reducing effect can be optimized.

Use of the arrangement of the sixth embodiment provides a hydraulic excavator capable of speeding up the excavation performed by the arm and the bucket in the interflow condition and translating the oil pressure loss reducing effect into the fuel consumption reducing effect in the split-flow condition.

EXPLANATION OF REFERENCE NUMERALS

Figure 1:
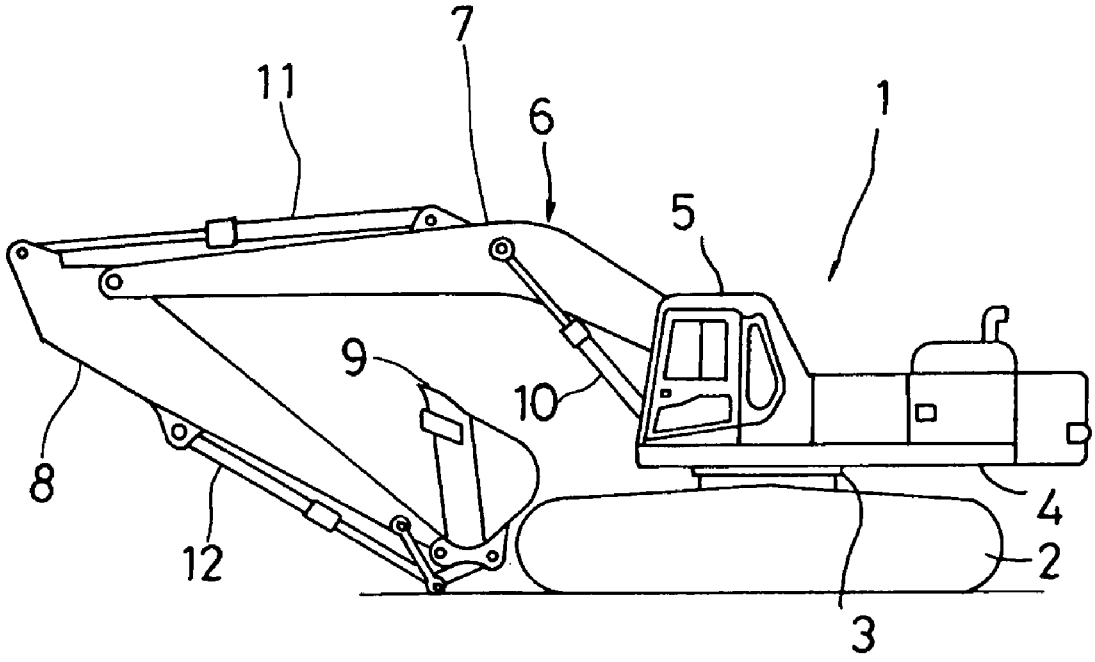
FIG. 1 is a side view of a hydraulic excavator according to one embodiment of the invention.

1: hydraulic excavator
8: arm
9: bucket
11: arm cylinder
12: bucket cylinder
15, 60: hydraulic drive control device
16: engine
17: hydraulic pump
17A: first hydraulic pump
17B: second hydraulic pump
19: fuel injection device
19*a*: electronic governor
20: controller
21: engine control unit
22: first directional control valve
25: second directional control valve
38: tank
40: first return circuit
41: second return circuit
42: quick return circuit
43: quick return valve
57, 68, 75: pressure sensor
61: first hydraulic circuit section
62: second hydraulic circuit section
77: interflow/split-flow selector valve
78: interflow/split-flow path

BEST MODE FOR CARRYING OUT THE INVENTION

Referring now to the accompanying drawings, the hydraulic drive control device of the invention will be described according to preferred embodiments. It should be noted that the following embodiments are associated with cases where the invention is applied to the hydraulic drive system of a hydraulic excavator.

First Embodiment

Figure 2:
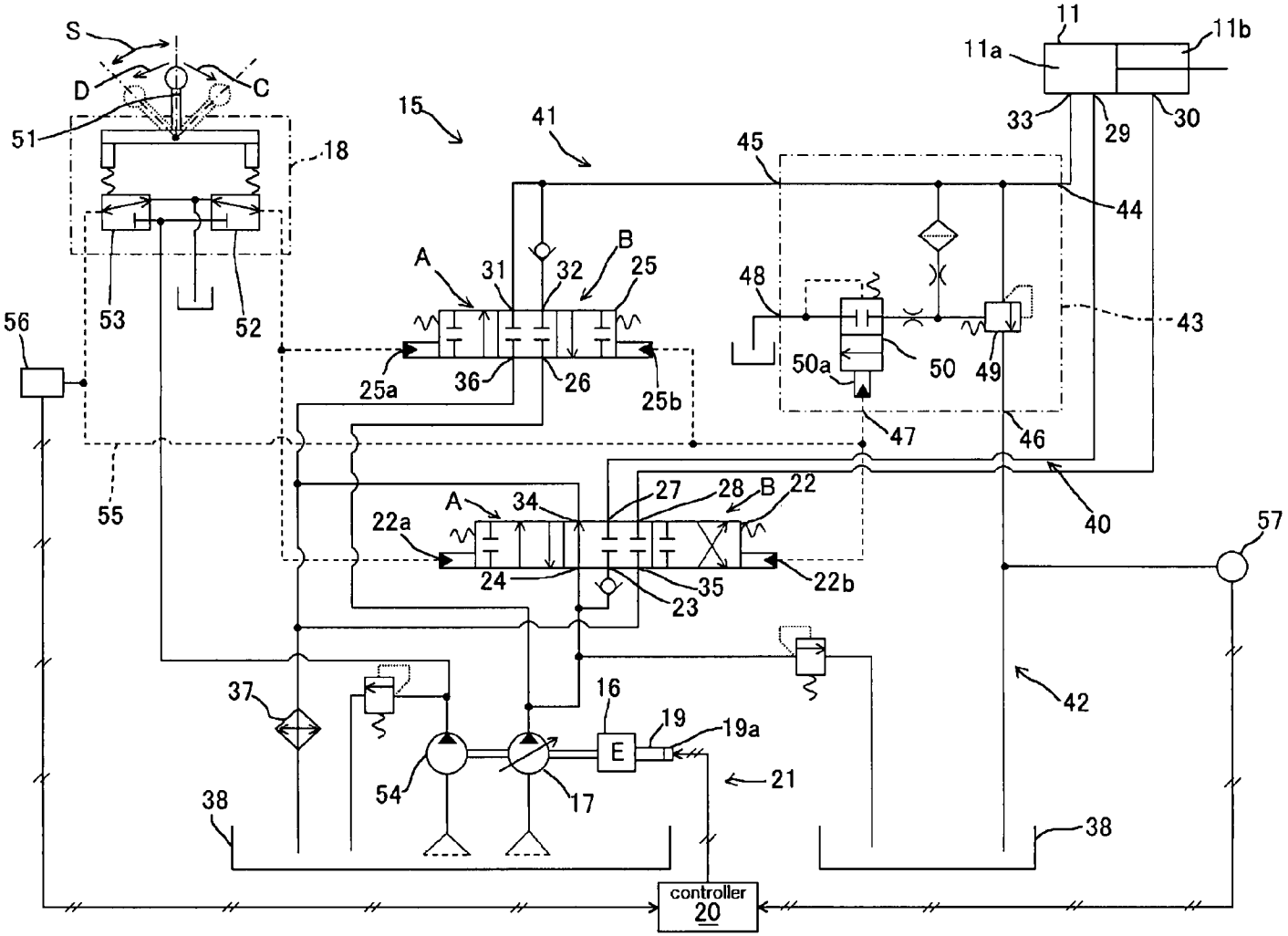
FIG. 2 is a hydraulic circuit diagram of a hydraulic drive control device according to a first embodiment of the invention.

FIG. 1 is a side view of a hydraulic excavator according to one embodiment of the invention. FIG. 2 is a hydraulic circuit diagram of a hydraulic drive control device according to a first embodiment.

As shown in FIG. 1, the hydraulic excavator 1 of this embodiment has lower traveling structure 2; upper structure 4 placed on the lower traveling structure 2 with a swivel 3 between; an operator's cab 5 disposed at a left front position of the upper structure 4; and a work implement 6 attached to a front center position of the upper structure 4. The work implement 6 is formed such that a boom 7, an arm 8 and a bucket 9 are pivotally connected and aligned in this order from the side of the upper structure 4. Hydraulic cylinders (a boom cylinder 10, an arm cylinder 11 and a bucket cylinder 12) are provided for the boom 7, the arm 8 and the bucket 9, respectively.

The hydraulic excavator 1 is equipped with a hydraulic drive control device 15 having, as shown in FIG. 2, a diesel engine 16, a variable displacement hydraulic pump 17 driven by the engine 16, and an operating means 18 provided in the operator's cab 5.

Figure 3:
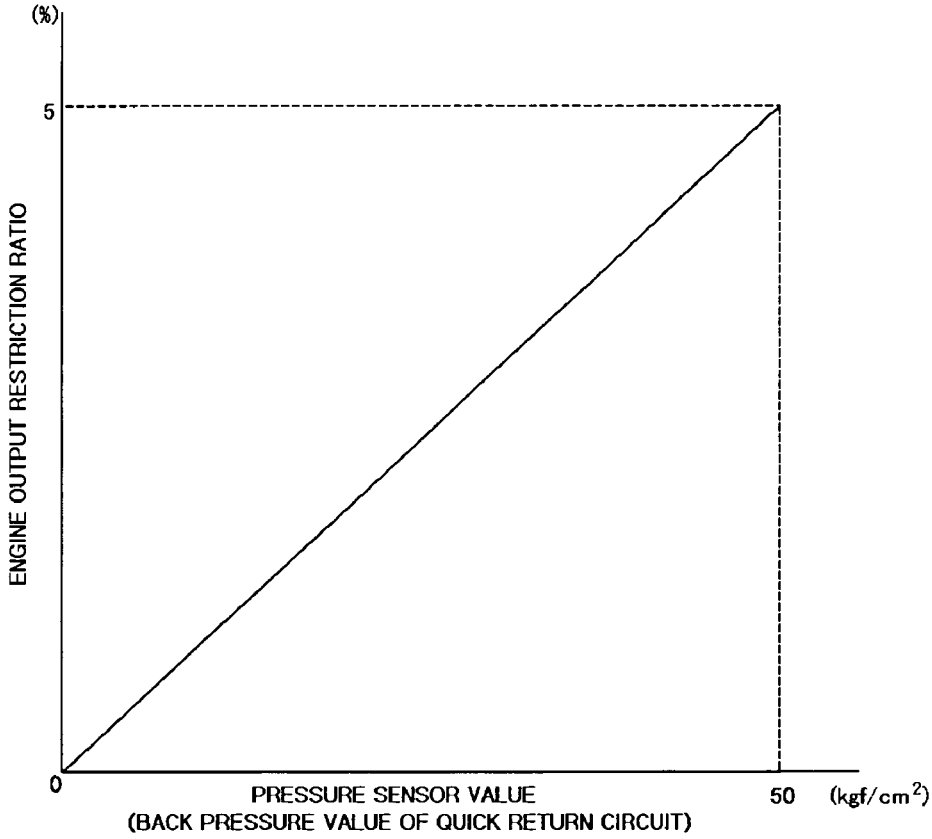
FIG. 3 is a control map associated with restriction control of the output of an engine.

The engine 16 includes a fuel injection device 19 equipped with an electronic governor 19*a*. Input to the electronic governor 19*a* is a fuel injection signal that is released from a controller 20 based on a fuel injection characteristic map set in relation with target engine output characteristic values. In this way, an arbitral engine output characteristic can be obtained. Herein, a control map (see FIG. 3) is stored in the storage region of the controller 20 beforehand. This control map is obtained in such a way that the amount of opening the quick return circuit 42, which has a positive correlation with the amount of reduction in the loss of oil pressure achieved thanks to the operation of the quick return circuit 42 (described later), is converted into the pressure value of the quick return circuit 42 and an engine output restriction ratio is set according to this pressure value. It should be noted that an engine control unit 21 including the fuel injection device 19 and the controller 20 corresponds to the "engine controlling means" of the invention.

The hydraulic pump 17 is connected to a pump port 23 and primary return port 24 of a first directional control valve 22 that consists of a three-position direction selector valve. The hydraulic pump 17 is also connected to a pump port 26 of a second directional control valve 25 consisting of a three-position direction selector valve.

Cylinder ports 27, 28 of the first directional control valve 22 are connected to a bottom A port 29 and head port 30, respectively, of the arm cylinder 11. On the other hand, cylinder ports 31, 32 of the second directional control valve 25 are connected to a bottom B port 33 of the arm cylinder 11. A secondary return port 34 and tank port 35 of the first directional control valve 22 and a tank port 36 of the second directional control valve 25 are connected to a tank 38 through an oil cooler 37.

In the hydraulic drive control device 15, the return circuit on the bottom side of the arm cylinder 11 is divided into two circuits, i.e., a first return circuit 40 and a second return circuit 41. Herein, the first return circuit 40 is constituted by a flow path for guiding a hydraulic oil discharged from a bottom oil chamber 11*a* from the bottom A port 29 to the tank 38 through the cylinder port 27 and tank port 35 of the first directional control valve 22 and the oil cooler 37. The second return circuit 41 is constituted by a flow path for guiding a hydraulic oil discharged from the bottom oil chamber 11*a* from the bottom B port 33 to the tank 38 through the cylinder port 31 and tank port 36 of the second directional control valve 25 and the oil cooler 37. The second return circuit 41 is provided with a quick return valve 43 for switching the hydraulic oil flowing in the circuit 41 to the quick return circuit 42 that directly flows the hydraulic oil back to the tank 38.

The quick return valve 43 includes (i) a quick return valve body having a cylinder port 44 connected to the bottom B port 33 of the arm cylinder 11, a valve port 45 connected to the cylinder ports 31, 32 of the second directional control valve 25, a tank port 46 connected to the tank 38, a pilot pressure oil input port 47 and a drain port 48; (ii) a main valve 49 for opening and closing the flow path between the cylinder port 44 and the tank port 46; and (iii) a control valve 50 for controlling the opening and closing of the main valve 49. When the control valve 50 receives a pilot pressure oil from a pilot valve 53 (described later) so that it is switched so as to establish communication between the cylinder port 44 and the drain port 48, the main valve 49 is opened thereby communicating the cylinder port 44 with the tank port 46.

The operating means 18 has a control lever 51 and pilot valves 52, 53 that are switched and operated by pressing the control lever 51 down. The input port of each pilot valve 52, 53 is connected to a pilot pump 54 for generating a pilot pressure oil. The output port of the pilot valve 52 is connected to an operating unit 22*a* of the first directional control valve 22 and an operating unit 25*a* of the second directional control valve 25. The output port of the pilot valve 53 is connected to another operating unit 22*b* of the first directional control valve 22; to another operating unit 25*b* of the second directional control valve 25; and to an operating unit 50*a* of the control valve 50 provided for the quick return valve 43.

A pilot pressure conduit line 55, which connects the output port of the pilot valve 53 to the operating unit 50*a* of the control valve 50, is provided with a pressure switch 56. The quick return circuit 42 is provided with a pressure sensor (back pressure detecting means) 57 for detecting the back pressure of the circuit 42. An ON signal from the pressure switch 56 and a back pressure detection signal from the pressure sensor 57 are input to the controller 20.

Reference is made to FIG. 2 for describing the operation of the hydraulic drive control device 15 of this embodiment having the above-described configuration.

After pressing the control lever 51 in the direction of arrow C of FIG. 2, a pilot pressure oil is released from the output port of the pilot valve 52. This pilot pressure oil works on the operating unit 22*a* of the first directional control valve 22 and on the operating unit 25*a* of the second directional control valve 25, so that the first directional control valve 22 and the second directional control valve 25 are respectively shifted to Position A. Thereby, the pressure oil discharged from the hydraulic pump 17 is guided so as to flow into to the bottom A port 29 of the arm cylinder 11 through the first directional control valve 22 and also guided so as to flow into the bottom B port 33 of the arm cylinder 11 through the second directional control valve 25, so that the pressure oil is supplied to the bottom oil chamber 11*a* of the arm cylinder 11. At the same time, the hydraulic oil of the head oil chamber 11*b* of the arm cylinder 11 is recovered from the head port 30 to the tank 38 through the first directional control valve 22 and the oil cooler 37. In this way, the arm excavating operation is performed in which the arm 8 is pivotally moved backward.

After pressing the control lever 51 in the direction of arrow D of FIG. 2, a pilot pressure oil is discharged from the output port of the pilot valve 53, working on the operating unit 22*b* of the first directional control valve 22 and on the operating unit 25*b* of the second directional control valve 25, so that the first directional control valve 22 and the second directional control valve 25 are respectively shifted to Position B. Thereby, the pressure oil discharged from the hydraulic pump 17 is guided so as to flow into to the head port 30 of the arm cylinder 11 through the first directional control valve 22 and supplied to the head oil chamber 11*b* of the arm cylinder 11. At the same time, the hydraulic oil of the bottom oil chamber 11*a* of the arm cylinder 11 is recovered from the bottom A port 29 to the tank 38 through the first directional control valve 22 and the oil cooler 37 and also recovered from the bottom B port 33 to the tank 38 through the second directional control valve 25 and the oil cooler 37. In this way, the arm dumping operation is performed in which the arm 8 is pivotally moved forward. In this arm dumping operation, since the pilot pressure oil from the pilot valve 53 works on the operating unit 50*a* of the control valve 50 provided for the quick return valve 43, shifting the control valve 50 to the open position, the main valve 49 of the quick return valve 43 is opened, thereby opening the quick return circuit 42. As the quick return circuit 42 is opened, most of the returning oil flowing in the second return circuit 41 flows back directly to the tank 38, so that the loss of oil pressure is considerably reduced.

While the quick return circuit 42 being opened, the ON signal from the pressure switch 56 is input to the controller 20. Therefore, the controller 20 recognizes from the input signal that the quick return circuit 42 is in its open state. Then, the controller 20 obtains the restriction ratio for the output of the engine by referring to the control map shown in FIG. 3 based on the pressure value of the quick return circuit 42 detected by the pressure sensor 57 and calculates a target engine output value from this calculated engine output restriction ratio and the output value of the engine just before opening of the quick return circuit 42. The controller 20 then controls the electronic governor 19*a* such that the output value of the engine becomes equal to the target engine output value. Suppose that the pressure value detected by the pressure sensor 57 is 50 kgf/cm$^2$ and the output value of the engine just before opening of the quick return circuit 42 is 280 PS. In this condition, the engine output restriction ratio is found to be 5% from the control map of FIG. 3 and the target engine output value is 280×0.95=266 PS. Therefore, the controller 20 controls the electronic governor 19*a* such that the output value of the engine becomes 266 PS.

According to the hydraulic drive control device 15 of the first embodiment, the loss of oil pressure is reduced by opening the quick return circuit 42 so that the working pressure required for contraction of the arm cylinder 11 can be reduced and, in consequence, the work load on the engine 16 is lessened. While the quick return circuit 42 is open, the output of the engine 16 is controlled by the engine control unit 21. Since the load on the engine is thus reduced by the opening operation of the quick return circuit 42 and in accordance with this, the output of the engine is restricted, fuel consumption can be reduced without giving a feeling of operational disorder to the operator even when the output of the engine drops. Accordingly, the oil pressure loss reducing effect can be translated into the fuel consumption reducing effect that is very real to the user.

Second Embodiment

Figure 4:
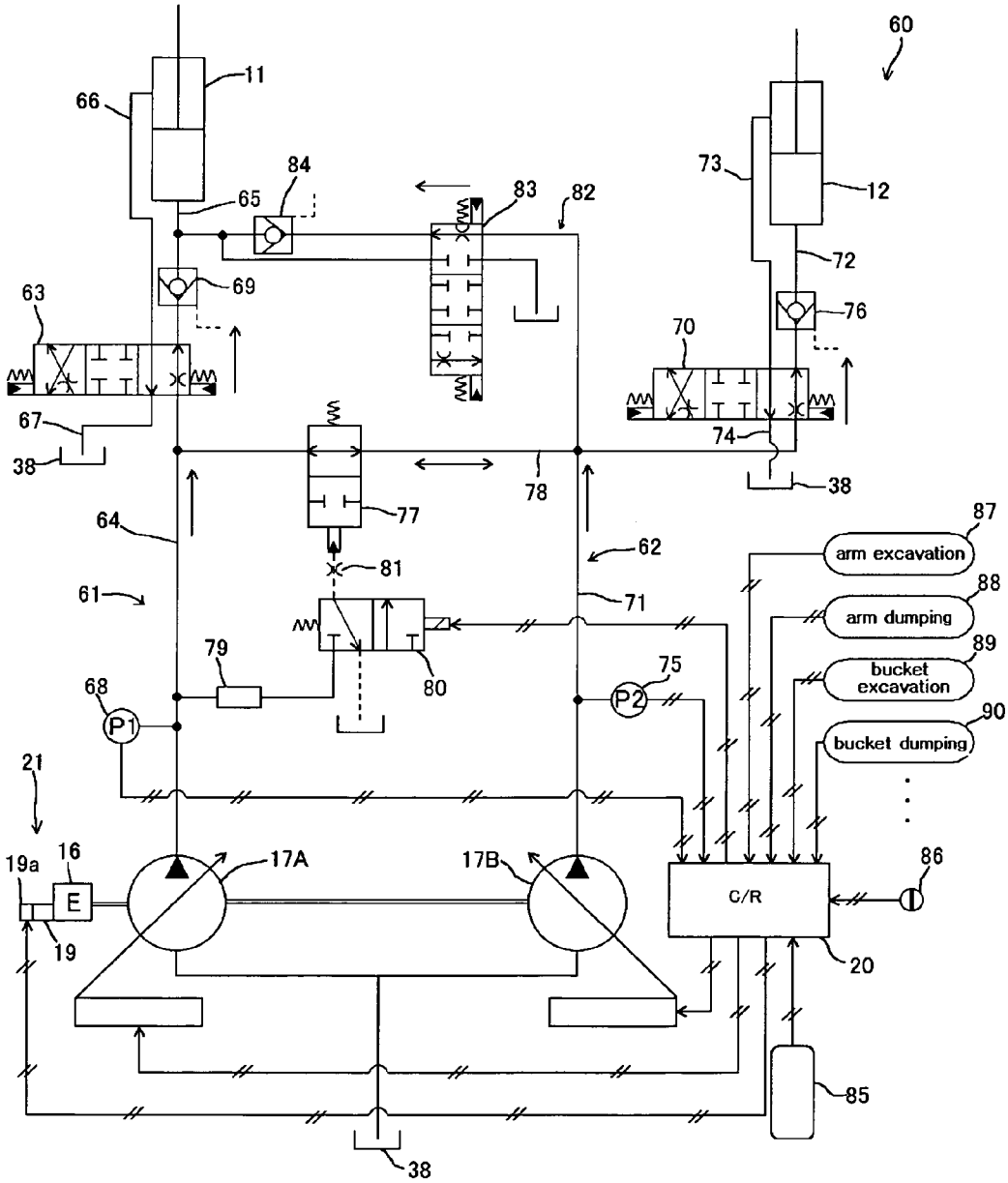
FIG. 4 is a hydraulic circuit diagram of a hydraulic drive control device according to a second embodiment of the invention.

Next, the hydraulic drive control device of the invention will be described according to a second embodiment with reference to the hydraulic circuit diagram of FIG. 4. In the second embodiment, the parts thereof corresponding to the first embodiment will be identified by the same reference numerals as in the first embodiment and a detailed explanation of them will be omitted. The hydraulic circuit diagram of FIG. 4 shows a circuit condition in which a first hydraulic circuit section (described later) is connected (joined) to a second hydraulic circuit section (described later) and the arm cylinder 11 and the bucket cylinder 12 are expanded thereby performing arm excavation and bucket excavation.

A hydraulic drive control device 60 according to the second embodiment has (i) a first hydraulic circuit section 61 for mainly driving the arm cylinder 11 by pressure oil discharged from a first variable displacement hydraulic pump 17A which is driven, using the engine 16 as a driving source; and (ii) a second hydraulic circuit section 62 for mainly driving the bucket cylinder 12 by pressure oil discharged from a second variable displacement hydraulic pump 17B which is driven, using the engine 16 as a driving source.

The first hydraulic circuit section 61 is provided with a flow rate and direction control valve 63 for the arm, for controlling the quantity of pressure oil supplied from the first hydraulic pump 17A to the arm cylinder 11 and switching the flow of pressure oil between supplying/draining directions. In the arm flow rate and direction control valve 63, (i) the pump port is connected to the output port of the first hydraulic pump 17A through a first discharge flow path 64; (ii) the cylinder A port is connected to the bottom oil chamber of the arm cylinder 11 through a supply/drain flow path 65; (iii) the cylinder B port is connected to the head oil chamber of the arm cylinder 11 through a supply/drain flow path 66; and (iv) the tank port is connected to the tank 38 through a drain flow path 67. Herein, the first discharge flow path 64 is provided with a pressure sensor 68 which releases a pressure detection signal to the controller 20. The supply/drain flow path 65 is provided with a first pressure compensation valve with a check function 69 interposed therein. This pressure compensation valve 69 is of an external pilot pressure operation type and allows a flow from the upstream to the downstream while inhibiting a flow from the downstream to the upstream.

The second hydraulic circuit section 62 is provided with a flow rate and direction control valve 70 for a bucket, for controlling the quantity of pressure oil supplied from the second hydraulic pump 17B to the bucket cylinder 12 and switching the flow of pressure oil between supplying/draining directions. In the bucket flow rate and direction control valve 70, (i) the pump port is connected to the output port of the second hydraulic pump 17B through a second discharge flow path 71; (ii) the cylinder A port is connected to the bottom oil chamber of the bucket cylinder 12 through a supply/drain flow path 72; (iii) the cylinder B port is connected to the head oil chamber of the bucket cylinder 12 through a supply/drain flow path 73; and (iv) the tank port is connected to the tank 38 through a drain flow path 74. Herein, the second discharge flow path 71 is provided with a pressure sensor 75 which releases a pressure detection signal to the controller 20. The supply/drain flow path 72 is provided with a second pressure compensation valve with a check function 76 interposed therein. This pressure compensation valve 76 is of an external pilot pressure operation type and allows a flow from the upstream to the downstream while inhibiting a flow from the downstream to the upstream.

The first discharge flowpath 64 and the second discharge flow path 71 are connected to each other through an interflow/split-flow path 78 having an interflow/split-flow selector valve 77 interposed therein. Herein, the interflow/split-flow selector valve 77 is switched when an electromagnetic selector valve 80 is switched in response to an instruction signal from the controller 20, the valve 80 being supplied with pressure oil from the first hydraulic pump 17A depressurized by a pressure reducing valve (constant secondary pressure type pressure reducing valve) 79. Thus, the timing of switching the electromagnetic selector valve 80 is changed thereby altering the setting of pressure associated with the opening/closing of the interflow/split-flow selector valve 77 according to various conditions. A proportional control valve (electromagnetic proportional control valve) or throttle 81 is interposed between the interflow/split-flow selector valve 77 and the electromagnetic selector valve 80. By operating the interflow/split-flow selector valve 77 little by little, a shock caused by switching of the interflow/split-flow selector valve 77 can be reduced.

Interposed between the first hydraulic circuit section 61 and the second hydraulic circuit section 62 is a bypass path 82 for bypassing the first and second hydraulic circuit sections 61, 62. Specifically, the bypass path 82 connects the first and second hydraulic circuit sections 61, 62 to each other such that part of pressure oil flowing to the second discharge flow path 71 is guided to the flow path located downstream of the first pressure compensation valve with a check function 69. This bypass path 82 is provided with (i) a flow rate control valve 83 for the high speed operation of the arm, the valve 83 being a flow rate/direction control valve similar to the arm flow rate/direction control valve 63; and (ii) a pressure compensation valve with a check function 84 of an external pilot pressure operation type, the valve 84 allowing pressure oil to flow into the arm cylinder 11 while inhibiting a reverse flow of it. The flow rate control valve 83 and the pressure compensation vale 84 are arranged in order from the upstream. Herein, the arm flow rate/direction control valve 63 and the flow rate control valve 83 for the high speed operation of the arm are operated in cooperation with each other in the following way. Specifically, where the arm cylinder 11 requires a large quantity of working fluid, the arm flow rate/direction control valve 63 is first opened and then, the flow rate control valve 83 for the high speed operation of the arm is opened, so that the valves 63, 83 are both in their open states. Where the arm cylinder 11 does not need such a large quantity of working fluid, the flow rate control valve 83 is closed so that only the arm flow rate/direction control valve 63 is in its open state.

Connected to the controller 20 are a monitor panel 85 for setting an operation mode which has been selected; a throttle dial 86 for setting a target engine rotational speed; and others. Herein, "a selected operation" is the rocking motion (excavating operation) of the arm 8, the rocking motion (excavating operation) of the bucket 9 or the like. Such various operations are selectively instructed upon receipt of an output signal released from any of pressure switches 87, 88, 89 and 90 provided for the control lever (not shown).

Figure 5:
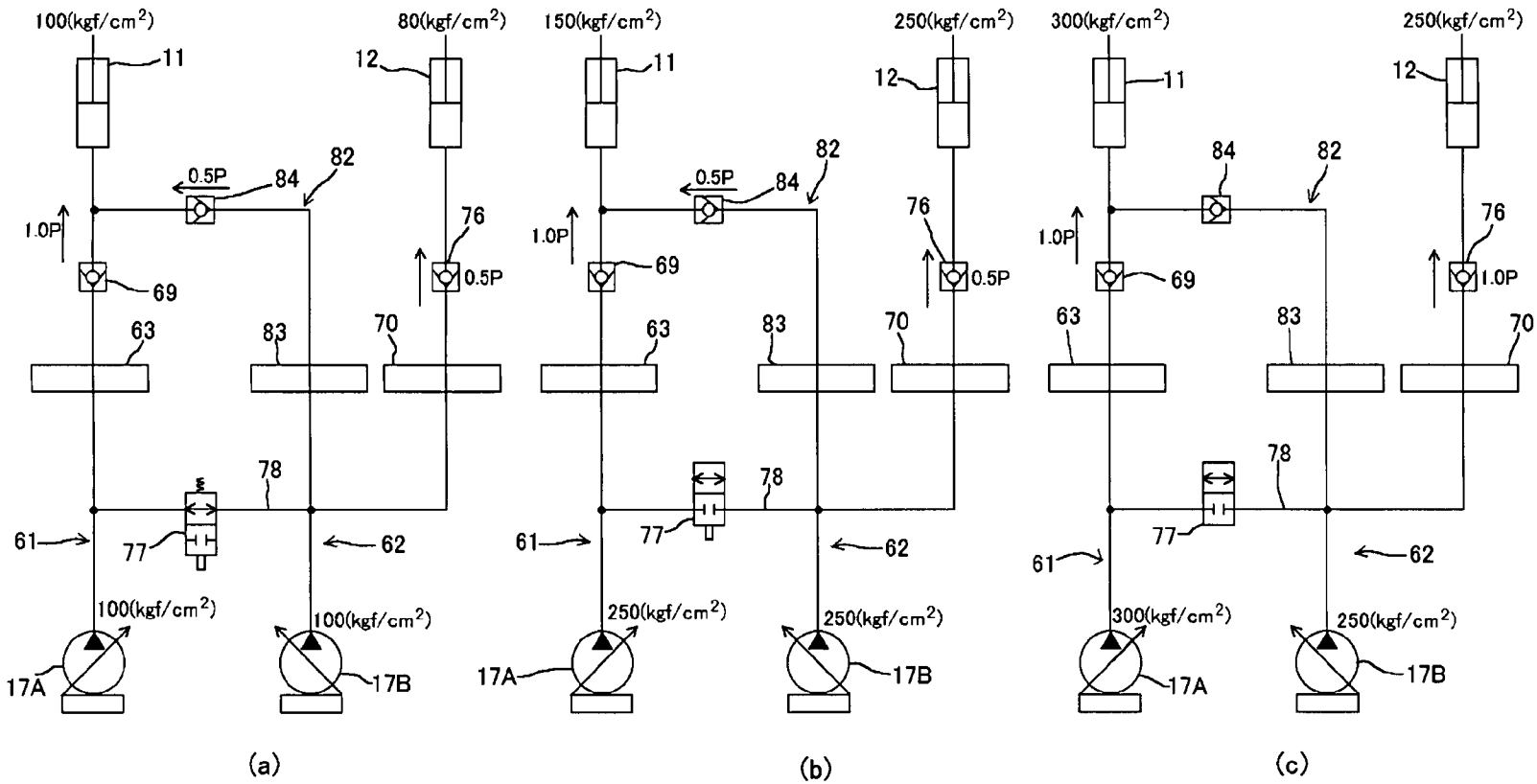
FIG. 5 is operation diagrams of the hydraulic drive control device of the second embodiment in which FIG. 5(*a*) schematically shows an interflow condition, FIG. 5(*b*) schematically shows a condition where the interflow condition is being switched to a split-flow condition, and FIG. 5(*c*) schematically shows the split-flow condition.

Referring to the schematic diagram of FIG. 5, there will be explained the fundamental operation of the hydraulic drive control device 60 of the second embodiment having the configuration described above. FIG. 5(*a*) shows an interflow condition, FIG. 5(*b*) shows a condition where the interflow condition is being switched to a split-flow condition, and FIG. 5(*c*) shows the split-flow condition.

As shown in FIG. 5(*a*), the first hydraulic circuit section 61 is joined to the second hydraulic circuit section 62, with the interflow/split-flow selector valve 77 being opened, so that the pressure oil from the second hydraulic pump 17B is supplied to the first hydraulic circuit section 61 through the interflow/split-flow path 78 and the bypass path 82. Explaining by way of a more concrete example, if the maximum pump capacity of each hydraulic pump 17A, 17B is 1.0 P and 1.5 P is necessary for driving the arm cylinder 11, the arm cylinder 11 can be driven by 1.0 P supplied from the first hydraulic pump 17A and 0.5 P supplied from the second hydraulic pump 17B. In this case, the pressure of each hydraulic pump 17A, 17B is, for example, 100 kgf/cm$^2$.

If the condition shown in FIG. 5(*a*) is shifted to the split-flow condition as shown in FIG. 5(*b*) by bringing the interflow/split-flow selector valve 77 into its closed position when the load pressure on the bucket cylinder 12 rises, pressure oil from the second hydraulic pump 17B is supplied to the arm cylinder 11 through the bypass path 82. Thus, there is little change in the flow rate when switching the interflow/split-flow selector valve 77 and therefore a shock caused by the change of the flow rate can be mitigated. It should be noted that the pressure of each of the hydraulic pumps 17A, 17B is, for example, 250 kgf/cm$^2$.

If the working pressure on the side of the arm cylinder 11 increases from the condition shown in FIG. 5(*b*), exceeding the working pressure on the side of the bucket cylinder 12, the flow of pressure oil into the arm cylinder 11 is stopped by the pressure compensation valve with a check function 84. That is, as the load pressure of the arm cylinder 11 increases, the quantity of fluid supplied to the arm cylinder 11 from the second hydraulic pump 17B decreases, so that the hydraulic drive control device 60 is smoothly brought into the split-flow condition shown in FIG. 5(*c*). In this case, the pressure of the first hydraulic pump 17A is 300 kgf/cm$^2$ and the pressure of the second hydraulic pump 17B is 250 kgf/cm$^2$.

Figure 6:
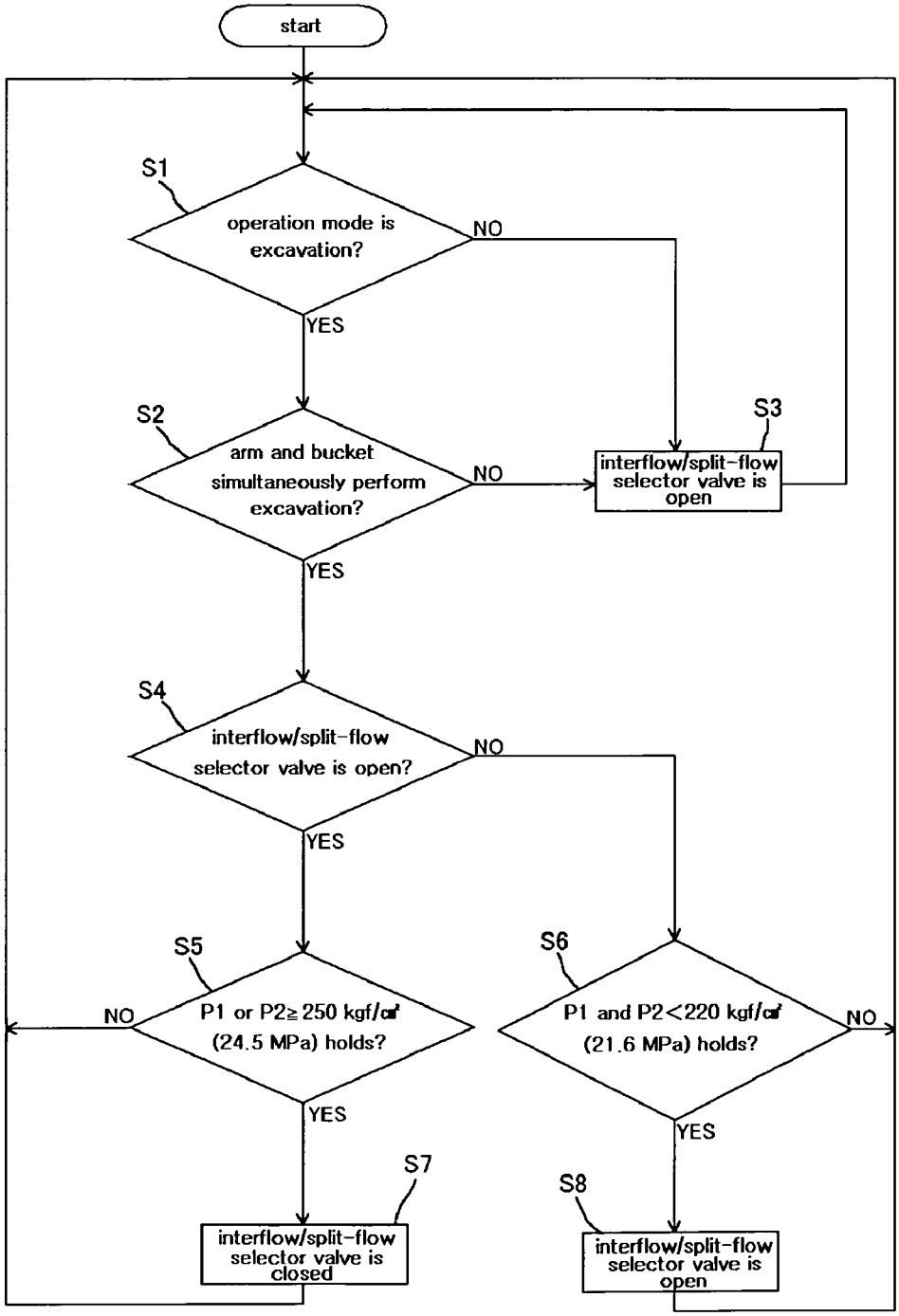
FIG. 6 is a flow chart showing the processing contents of interflow/split-flow switching control.

Next, reference is made to the flow chart of FIG. 6 to explain the details of the contents of the processing performed by the controller 20 when the flows in the first hydraulic circuit section 61 and the second hydraulic circuit section 62 are combined or split. It should be noted that, during the flow-combining and flow-splitting operations, other operations (e.g., traveling and a turn of the upper structure 4) performed by the hydraulic excavator 1 are stopped. When the term "excavation" is used in the following description, it should be understood that it means an operation including both the excavating operation of the arm 8 and the excavating operation of the bucket 9.

At Step S1, a check is firstly made to determine whether or not the operation mode is "excavation" based on ON signals from the pressure switches 87, 88, 89, 90. If the operation mode is "excavation", operation proceeds to Step S2. If the operation mode is not "excavation", operation proceeds to Step S3. At Step S3, if the interflow/split-flow selector valve 77 is in a closed position, the valve 77 is brought into an open position and operation returns to Step S1. On the other hand, if the interflow/split-flow selector valve 77 is in the open position, the valve 77 is left in the open position as it is and operation returns to Step S1.

At Step S2, a check is made to determine whether the excavating operation by the arm 8 and the excavating operation by the bucket 9 are simultaneously performed. If the excavating operations by the arm 8 and the bucket 9 are not simultaneously performed, operation proceeds to Step S3. On the other hand, if the excavating operations by the arm 8 and the bucket 9 are simultaneously performed, operation proceeds to Step S4. At Step S4, it is determined whether the interflow/split-flow selector valve 77 is in its open position. If the interflow/split-flow selector valve 77 is in its open position, operation proceeds to Step S5. If the interflow/split-flow selector valve 77 is in its closed position, operation proceeds to Step S6.

At Step S5, a check is made to determine whether P1 or P2≧250 kgf/cm$^2$ (24.5 MPa) holds. In this expression, P1 is the pressure detected by the pressure sensor 68 whereas P2 is the pressure detected by the pressure sensor 75. If P1 or P2 is 250 kgf/cm$^2$ or more, the interflow/split-flow selector valve 77 is brought into its closed position, thereby establishing the split-flow condition (S7). On the other hand, if P1 or P2≧250 kgf/cm$^2$ does not hold, operation returns to Step S1.

At Step S6, a check is made to determine whether P1 and P2<220 kgf/cm$^2$ (21.6 MPa) holds. If P1 and P2 are both less than 220 kgf/cm$^2$, the interflow/split-flow selector valve 77 is brought into its open position, thereby establishing the interflow condition (S8). On the other hand, if P1 and P2<220 kgf/cm$^2$ does not hold, operation returns to Step S1.

According to the second embodiment, as the interflow condition is switched to the split-flow condition at Step S7, the engine control unit 21 restricts the output of the engine 16 (e.g., Δ3%).

According to the hydraulic drive control device 60 of the second embodiment, when P1 or P2 becomes 250 kgf/cm$^2$ or more in the interflow condition, the device 60 is switched to the split-flow condition to thereby reduce the loss of oil pressure and the output of the engine is restricted in accordance with this, so that the output of the engine can be dropped, thereby reducing fuel consumption without giving a feeling of disorder to the user. In this way, the oil pressure loss reducing effect can be translated into the fuel consumption reducing effect which is very real to the user. In addition, if P1 and P2 are both 220 kgf/cm$^2$ or less in the split-flow condition, the device 60 is brought into its interflow condition and the arm or bucket can be operated at high speed.

According to the hydraulic drive control device 60 of the second embodiment, since the switching between the interflow condition and the split-flow condition is done based on the discharge pressure of the hydraulic pumps 17A, 17B, the interflow condition can be more properly switched to the split-flow condition so that the fuel consumption reducing effect can be optimized. In addition, since the reference pressure when the flows in the hydraulic circuit sections 61, 62 are combined is different from the reference pressure when the flows in the hydraulic circuit sections 61, 62 are split, hunting caused at the time of switching between the interflow and split-flow conditions can be avoided and therefore the reliability of the switching operation is increased.

Although the hydraulic excavator 1 has either the hydraulic drive control device 15 or 60 in each of the foregoing embodiments, the hydraulic excavator 1 may have both the hydraulic drive control devices 15 and 60. In this case, it is obvious that a further reduction in fuel consumption can be attained.

INDUSTRIAL APPLICABILITY

The hydraulic drive control device of the invention is applicable to not only hydraulic excavators but also construction machines such as wheel loaders, agricultural machines and industrial vehicles.

The invention claimed is:

1. A hydraulic drive control device comprising a driving hydraulic circuit for driving a hydraulic actuator by supplying pressure oil to or draining it from the hydraulic actuator through a control valve, the pressure oil being discharged from a hydraulic pump driven by an engine and a quick return circuit for directly flowing a part of hydraulic oil discharged from the hydraulic actuator back to a tank, while the hydraulic actuator being driven, the hydraulic drive control device further comprising:

engine controlling means for controlling an output of the engine such that the output of the engine is restricted when the quick return circuit is opened.

2. The hydraulic drive control device according to claim 1, wherein back pressure detecting means for detecting a back pressure of the quick return circuit is provided and the engine controlling means adjusts an amount of restricting the output of the engine based on a value of the back pressure detected by the back pressure detecting means.

3. The hydraulic drive control device according to claim 1, wherein the hydraulic actuator is an arm cylinder for a hydraulic excavator and the quick return circuit is operated during dumping operation of an arm.

4. The hydraulic drive control device according to claim 2, wherein the hydraulic actuator is an arm cylinder for a hydraulic excavator and the quick return circuit is operated during dumping operation of an arm.

* * * * *